United States Patent [19]

Courter et al.

[11] Patent Number: 4,497,985

[45] Date of Patent: Feb. 5, 1985

[54] LINE AND PROGRAM SWITCH ASSEMBLY FOR A TIMING MECHANISM

[75] Inventors: Harry I. Courter, Indianapolis; Leroy A. Perry, Danville, both of Ind.

[73] Assignee: Emhart Industries, Inc., Indianapolis, Ind.

[21] Appl. No.: 507,738

[22] Filed: Jun. 27, 1983

[51] Int. Cl.[3] ..... H01H 7/00

[52] U.S. Cl. ..... 200/38 R; 200/38 B

[58] Field of Search ..... 200/38 R, 38 B, 38 BA

[56] References Cited

U.S. PATENT DOCUMENTS 4,146,760 3/1979 Voland ..... 200/38 B 4,413,164 11/1983 Obermann et al. ..... 200/38 R

*Primary Examiner*—A. D. Pellinen

*Assistant Examiner*—Morris Ginsburg

*Attorney, Agent, or Firm*—Robert F. Meyer

[57] ABSTRACT

An electrical contact blade is manually operated through an actuator to close a circuit to a main power supply and another electrical contact blade is operated off of a cam to engage the manually operated blade to complete a program electrical circuit.

1 Claim, 4 Drawing Figures

LINE AND PROGRAM SWITCH ASSEMBLY FOR A TIMING MECHANISM

BACKGROUND OF THE INVENTION

Generally speaking, the present invention pertains to a timing mechanism which comprises a program cam and switch assembly selectively opening and closing electrical circuits to provide variable programs, power drive means applying power driven rotation to the cam assembly, and an electrical power line switch and program switch assembly comprising a power line switch including a line switch electrical contact blade electrically adapted to be connected to a main power supply, a manually operable actuator means engaging the line switch electrical contact blade, and at least one program electrical contact blade of the program switch assembly biased by a cam of the cam assembly to selectively engage the line switch electrical contact blade.

The present invention is directed to a timing mechanism, and more particularly, to a timing mechanism utilizing a line switch.

Timing mechanisms have been used for many years to control the operation of an appliance such as a washer, dryer and dishwasher. In most, if not all, of such application a line switch is usually used to provide a manual means of shutting off all electrical power to the timing mechanism. Generally speaking, such line switches are operable off of the main cam of the timing mechanism and thus use up space on the cam which could be made available for appliance program switching. In accordance with the present invention, a line switch assembly is provided which provides the capability of an additional program switching to be used in conjunction with the cam. Such an arrangement provides the advantage that when additional switching capability is required, the cost of an additional terminal block may be prevented.

OBJECTS OR FEATURES OF THE INVENTION

It is, therefore, a feature of the present invention to provide a cooperating power line switch and program switch assembly. Another feature of the invention is to provide a power line switch including a line switch electrical contact blade adapted to be electrically connected to a main power supply, a manually operable actuator means operating the power line switch, and an electrical contact blade of the program switch assembly engaging the power line switch.

These and other features of the invention will be apparent from the following description taken in conjunction with the accompanying drawings.

DETAILED DESCRIPTION OF THE INVENTION

Figure 1:
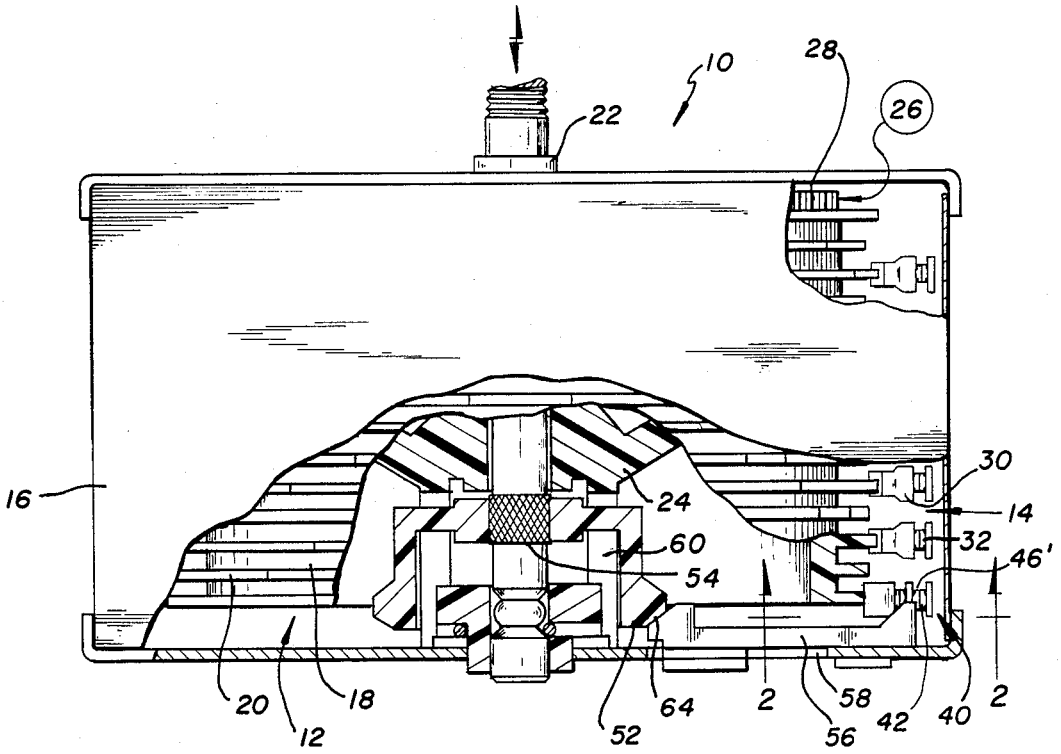
FIG. 1 is a section taken in elevation of a timing mechanism employing the features of the invention.
Figure 2:
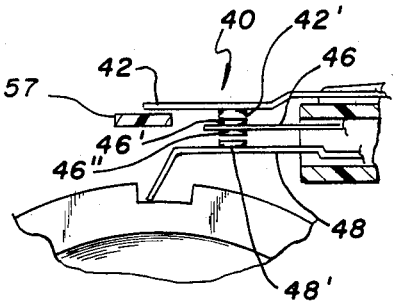
FIGS. 2 and 3 are views taken along the line 2—2 of FIG. 1 showing a different operating mode of the line switch and program switch assembly of the timing mechanism.
Figure 3:
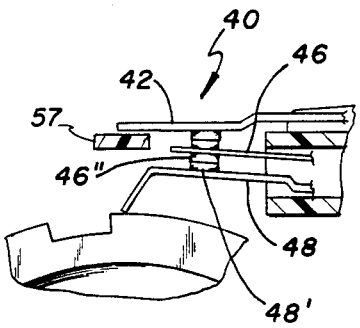

Referring now to FIGS. 1–3, there is shown a timing mechanism 10 employing the features of the invention. The timing mechanism, in general, includes a cam assembly 12 and switch assembly 14 which are carried in a housing 16. Cam assembly 12 includes a cam stack 18 having a plurality of individual cams 20 thereon and which is rotatably carried on a shaft 22 through a hub portion 24. The cam stack is rotated through a power drive means 26, such as a synchronous motor, the motor being coupled to a gear 28 which is part of the camstack. Shaft 22 is manually axially indexable.

Switch assembly 14 includes a plurality of electrical contact spring blades 30 which engage or are otherwise biased by the cams 20 of the cam assembly to open and close electrical contacts 32 associated with each blade to complete electrical circuits and thus provide variable programs for an appliance, for example.

In accordance with the present invention, there is provided a combination electrical power line switch and program switch assembly 40 which provides for manual removal of electrical power from the timing mechanism as well as provide a program function. Prior art line switch assemblies have been separate and distinct from the program switches thus adding to the cost of the timing mechanism.

Figure 4:
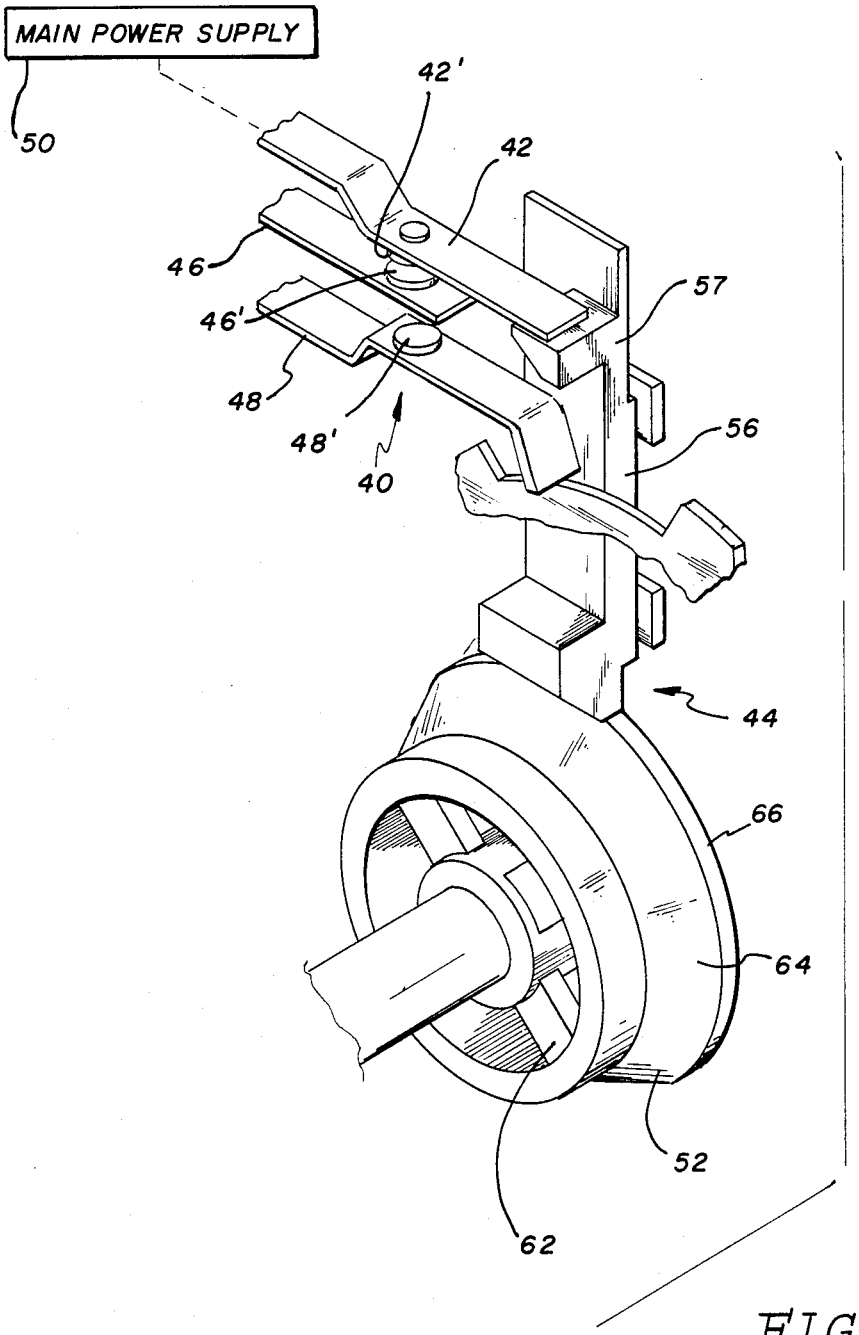
FIG. 4 is an exploded view showing the combination line switch and program switch assembly.

Referring to FIG. 4, electrical power line switch and program switch assembly 40 includes line switch electrical contact blade 42, actuator means 44, and program switch assembly electrical contact blades 46 and 48. Line switch electrical contact blade 42 is electrically connected to a main power supply 50 such as an electrical outlet of a building where an appliance is situated. As shown in FIGS. 2, 3 and 4, each blade includes mating electrical contacts 42', 46', 46'', and 48'.

Referring to FIGS. 1 and 4, actuator means 44 includes a hub 52, which is carried on shaft 22 through knurl 54, and slider 56 which engages the hub and slides in slot 58. Slider 56 includes a shelf 57 which engages blade 42. Hub 52 rotates with hub portion 24 of camstack 18 through a plurality of tongues 60 extending from the hub portion 24 and engaging web 62 carried in hub 52. Hub 52 includes a tapered rim 64 against which the slider is biased.

Referring now to FIGS. 1 through 3, the operation of the timing mechanism can now be described. In FIG. 1, shaft 22 has been indexed out to allow the slider to move down rim 64. As better shown in FIG. 2, movement of the slider to this position closes contacts 42' and 46' to close the line switch to complete an electrical circuit to main power supply 50. In FIG. 3, blade 48 has risen to the top of one of the individual cam 20 to close contacts 46'' and 48' to complete a program circuit.

With the shaft 22 indexed in, slider 56 moves to the outer edge 66 of rim 64 (FIG. 4) to open the line switch through shelf 57. In this position, the position of contacts 46'' and 48' is immaterial since the circuit to the main power supply 50 is open.

What is claimed is:

1. A timing mechanism comprising a program cam and switch assembly selectively opening and closing electrical circuits to provide variable programs, power drive means applying power driven rotation to said cam assembly, and an electrical power line switch included as part of said program cam and switch assembly comprising a power line switch including a line switch electrical contact blade electrically adapted to be connected to a main power supply, a manually operable actuator means engaging said line switch electrical contact blade, a program electrical contact blade of said program cam and switch assembly biased by a cam of said program cam and switch assembly, and at least one electrical contact blade carried between said line switch electrical contact blade and said program electrical contact blade.

* * * * *